US011230895B1

(12) United States Patent
Cook et al.

(10) Patent No.: US 11,230,895 B1
(45) Date of Patent: Jan. 25, 2022

(54) OPEN WATER COILED TUBING CONTROL SYSTEM

(71) Applicant: Oceaneering International, Inc., Houston, TX (US)

(72) Inventors: John R. Cook, Kingwood, TX (US); Robert L. Ewen, Cypress, TX (US); Harris Akhtar Iqbal, Porter, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 17/038,247

(22) Filed: Sep. 30, 2020

(51) Int. Cl.
*E21B 19/00* (2006.01)
*E21B 19/09* (2006.01)
*E21B 19/22* (2006.01)

(52) U.S. Cl.
CPC ..... *E21B 19/22* (2013.01); *E21B 19/006* (2013.01); *E21B 19/09* (2013.01)

(58) Field of Classification Search
CPC ..... E21B 19/006; E21B 19/09; E21B 19/22
See application file for complete search history.

(56) References Cited

U.S. PATENT DOCUMENTS 6,116,345 A * 9/2000 Fontana ..... B65H 75/22 166/343
6,142,406 A * 11/2000 Newman ..... B21C 47/18 166/77.2
6,457,534 B1 * 10/2002 Rolovic ..... E21B 19/22 166/381
6,843,321 B2 * 1/2005 Carlsen ..... E21B 19/002 166/355
7,150,324 B2 * 12/2006 Laursen ..... E21B 7/128 166/355
7,431,092 B2 * 10/2008 Haheim ..... E21B 19/22 166/343
7,530,399 B2 * 5/2009 Dreelan ..... E21B 19/008 166/355
7,685,892 B2 * 3/2010 Hoen ..... E21B 17/20 73/862.391
8,439,109 B2 * 5/2013 Sbordone ..... E21B 47/001 166/250.01
8,720,582 B2 * 5/2014 Portman ..... E21B 19/22 166/348
9,347,294 B2 * 5/2016 Gramstad ..... E21B 19/002
9,670,768 B2 * 6/2017 Turner ..... E21B 19/22
(Continued)

*Primary Examiner* — Matthew R Buck
(74) *Attorney, Agent, or Firm* — Maze IP Law, P.C.

(57) ABSTRACT

A coiled tubing string may be moved into and/or out from water by deploying an open water coiled tubing control system at sea such as via a vessel. The open water coiled tubing control system comprises a reel configured to accept a coiled tubing string, a surface injector, a reel tensioner configured to control an arch formed by the coiled tubing string between the reel and the surface injector, a controller, a subsea assist jack, and a predetermined set of a predetermined set of sensors. Motion of the surface injector and the subsea assist jack are used in part to move the coiled tubing string accepted by the reel into and/or out of a subsea well by receiving various information at the controller from the predetermined set of sensors and using the controller to resolve the received information to move the coiled tubing string into or out from the subsea well at a predetermined desired speed to achieve an outcome commanded by a single input from an operator.

10 Claims, 1 Drawing Sheet

(56) References Cited

U.S. PATENT DOCUMENTS

| | | | | |
|---|---|---|---|---|
| 9,765,610 | B2 * | 9/2017 | Turner | E21B 47/007 |
| 9,822,613 | B2 * | 11/2017 | Crawford | E21B 19/09 |
| 10,883,894 | B2 * | 1/2021 | Rice | E21B 17/017 |
| 2020/0080416 | A1 * | 3/2020 | Hebert | G01L 5/04 |

* cited by examiner

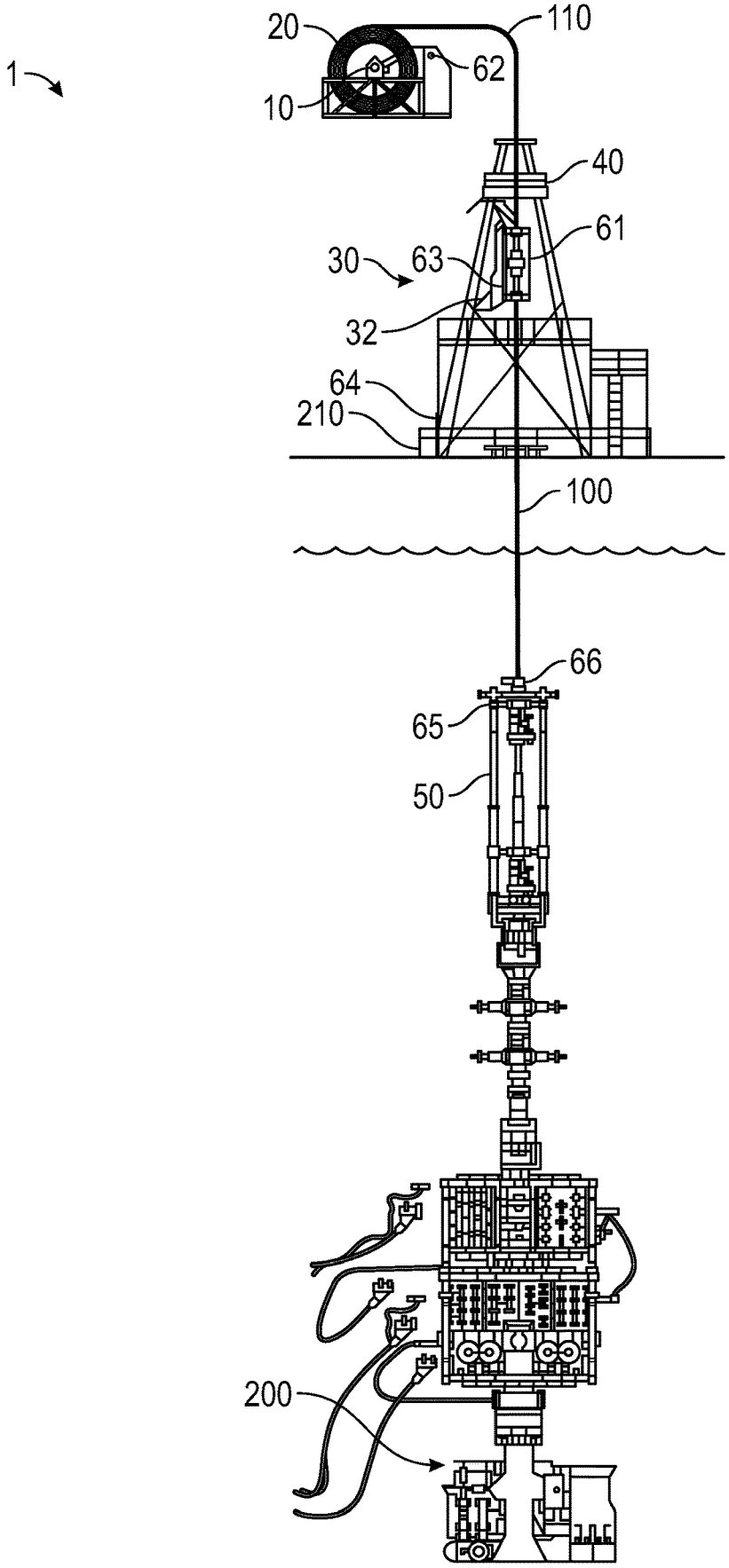
1
20
10
62
110
40
61
30
63
32
64
210
100
66
65
50
200

OPEN WATER COILED TUBING CONTROL SYSTEM

RELATION TO OTHER APPLICATIONS

This application claims priority through U.S. Provisional Application 62/924,045 filed on Oct. 21, 2019.

BACKGROUND

Running coiled tubing (CT) in open water from a vessel, and then possibly directly through a subsea tree, as well as running CT by utilizing an injector on a vessel and an injector on the subsea tree/wellhead typically comprises concerns with maintenance of tension between vessel injector and subsea injector and/or reliance of passive heave control for the vessel injector. A direct hydraulic control system, e.g. a vessel to subsea assist jack, is impractical as the whip effect stress wave travels at near the speed of sound in the coiled tubing steel (damped by the surrounding water) whereas the transmission of a hydraulic pressure change command travels at the speed of sound in the hydraulic fluid. The former is approximately four times faster than the later.

Existing systems do not disclose or render obvious an integrated control system that responds to a single operator input and controls.

FIGURES

Various FIGURES are included herein which illustrate aspects of embodiments of the disclosed inventions.

FIG. 1 is a block diagram of an exemplary open water coiled tubing control system.

DESCRIPTION OF EXEMPLARY EMBODIMENTS

In a first embodiment, referring generally to FIG. 1, open water coiled tubing control system 1 comprises reel 20 configured to accept and spool/unspool coiled tubing string 100; one or more surface injectors 30 operatively in fluid communication with coiled tubing string 100; one or more reel tensioners 10 configured to control arch 110 formed by coiled tubing string 100 where control arch 110 is disposed in-between reel 20 and surface injector 30; and one or more controllers 40 configured to control reel tensioner 10 and allow movement of coiled tubing string 100 and surface injector 30 relative to each other without adding additional fatigue life consumption due to vessel heave.

Open water coiled tubing control system 1 typically uses surface injector motion to move coiled tubing string 100 into/out of the water.

Typically, coiled tubing string 100 is disposed about an outer surface of reel 20 but other embodiments are contemplated such as being disposed within or partially within reel 20.

Surface injector 30 may be mounted on heave compensator 32.

In embodiments, controller 40 is disposed intermediate reel 20 and surface injector 30 above a water level such as by being connected to, or otherwise mounted on or to, vessel 210.

In certain embodiments, open water coiled tubing control system 1 further comprises subsea assist jack 50 to move coiled tubing string 100 into/out of subsea well 200.

In most embodiments, open water coiled tubing control system 1 comprises a predetermined set of sensors (generally referred to but not specifically shown in the FIGURE as callout "60"), which may be integrated into other components or separate. Typically, the predetermined set of sensors 60 are operatively in communication with controller 40 and comprises one or more surface injector load sensors 61 configured to detect and provide data related to a load at surface injector 30; one or more coiled tubing string movement sensors 62 configured to detect and provide data related to movement of coiled tubing string 100 in reel tensioner 10 where the data comprise speed of movement; one or more surface injector movement sensors 63 configured to detect and provide data related to movement of surface injector 30; and one or more vessel movement sensors 64 configured to detect and provide data related to movement of vessel 210 where the data comprise active heave data and/or passive heave data. In embodiments comprising subsea assist jack 50, the predetermined set of sensors 60 typically also comprise one or more subsea assist jack load sensors 65 configured to detect and provide data related to a load at subsea assist jack 50 and one or more subsea assist jack movement sensors 66 configured to detect and provide data related to movement of subsea assist jack 50.

In the operation of exemplary methods, referring back to FIG. 1, in an embodiment, open water coiled tubing control system 1 is deployed such as via vessel 210 which may also used to support surface injector 30. Open water coiled tubing control system 1 receives information related to a load at surface injector 30 and, if present, at subsea assist jack 50; information on movement of coiled tubing string 100 in reel tensioner 10, surface injector 30, and, if present, subsea assist jack 50; and information on movement of vessel 210 or a compensation system such as heave compensator 32 used to support surface injector 30, e.g. either active or passive heave.

Open water coiled tubing control system 1 resolves all or a predetermined part of the information so received, e.g. by controller 40, to effect movement of coiled tubing string 100 into and/or out from subsea well 200 at a predetermined desired speed to achieve an outcome by having one or more commands issued to reel tensioners 10 by a single input from an operator. Typically, this is accomplished by an operator using controller 40 to issue one or more commands to reel 20, surface injectors 30, and reel tensioners 10 substantially simultaneously.

In currently contemplated methods, part of the resolved solution is to maintain coiled tubing string 100 at a predetermined tension in-between surface injector 30 and subsea assist jack 50. Typically, controller 40 uses the information it receives from sensors 60 and determines a continuous movement rate of surface injector 30 versus an interrupted rate of subsea assist jack 50.

In certain embodiments, subsea assist jack 50 can be remotely disengaged from gripping coiled tubing string 100 when the force supplied by subsea assist jack 50 is no longer required to move coiled tubing string 100 into or out of subsea well 200. This can be accomplished by traditional means and/or by an instruction provided to controller 40 from a remote location or the like.

Open water coiled tubing control system 1 typically needs to have limited hysteresis to avoid a "whip effect" caused in part by an induced vessel movement resulting from wave action. Knowledge of the "whip effect" and the speed of translation on the stress wave through coiled tubing string 100 allows a determination of required system performance and operating limits of open water coiled tubing control system 1 versus the "sea state."

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. An open water coiled tubing control system, comprising:

a) a reel configured to accept a coiled tubing string;

b) a surface injector in fluid communication with the coiled tubing string;

c) a reel tensioner configured to control an arch formed by the coiled tubing string between the reel and the surface injector;

d) a controller configured to control the reel tensioner and allow movement of the coiled tubing string and the surface injector relative to each other without adding additional fatigue life consumption due to vessel heave; and e) a predetermined set of sensors operatively in communication with the controller, the predetermined set of sensors comprising:

i) a surface injector load sensor configured to detect and provide data related to a load at the surface injector;

ii) a coiled tubing string movement sensor configured to detect and provide data related to movement of the coiled tubing string in the reel tensioner, the data comprising speed of movement;

iii) a surface injector movement sensor configured to detect and provide data related to movement of the surface injector; and iv) a vessel movement sensor configured to detect and provide data related to movement of a vessel, the data comprising active heave data or passive heave data.

2. The open water coiled tubing control system of claim 1, wherein the reel is configured to accept the coiled tubing string about an outer surface of the reel and/or to accept the coiled tubing string partially within the reel.

3. The open water coiled tubing control system of claim 1, wherein the controller is disposed intermediate the reel and the surface injector.

4. The open water coiled tubing control system of claim 1, wherein the controller is connected or otherwise mounted to the vessel.

5. The open water coiled tubing control system of claim 1, further comprising:

a) a subsea assist jack configured to move the coiled tubing string into or out of a subsea well;

b) a subsea assist jack load sensor configured to detect and provide data related to a load at the subsea assist jack; and c) a subsea assist jack movement sensor configured to detect and provide data related to movement of the subsea assist jack.

6. The open water coiled tubing control system of claim 5, wherein the subsea assist jack is deployed into the water from the vessel.

7. A method moving a coiled tubing string into and/or out from water, comprising:

a) deploying an open water coiled tubing control system at sea with a vessel, the open water coiled tubing control system, comprising a reel configured to accept a coiled tubing string, a surface injector in fluid communication with the coiled tubing string and supported by the vessel, a reel tensioner configured to control an arch formed by the coiled tubing string between the reel and the surface injector, a controller configured to control the reel tensioner and allow movement of the coiled tubing string and the surface injector relative to each other without adding additional fatigue life consumption due to vessel heave, a subsea assist jack configured to move the coiled tubing string into or out of a subsea well, and a predetermined set of sensors comprising a load sensor configured to detect and provide data related to a load at the surface injector, a coiled tubing string movement sensor configured to detect and provide data related to movement of the coiled tubing string in the reel tensioner, the data comprising speed of movement, a surface injector movement sensor configured to detect and provide data related to movement of the surface injector, a vessel movement sensor configured to detect and provide data related to movement of the vessel where the data comprise active heave data or passive heave data, a subsea assist jack load sensor configured to detect and provide data related to a load at the subsea assist jack, and a subsea assist jack movement sensor configured to detect and provide data related to movement of the subsea assist jack;

b) using motion of the surface injector and the subsea assist jack to move a coiled tubing string accepted by the reel into and/or out of a subsea well by:

i) receiving information at the controller from the predetermined set of sensors representing a load at the surface injector and at the subsea assist jack;

ii) receiving information at the controller from the predetermined set of sensors on movement of the coiled tubing string in the reel tensioner, the surface injector, and the subsea assist jack;

iii) receiving information at the controller from the predetermined set of sensors on movement of the vessel used to support the surface injector;

iv) using the controller to resolve the received information to move the coiled tubing string into or out from the subsea well at a predetermined desired speed to achieve an outcome commanded by a single input from an operator, the single input from the operator comprising a command sent to the reel, the surface injector, and the reel tensioner substantially simultaneously.

8. The method moving a coiled tubing string into and/or out of water of claim 7, further comprising maintaining the coiled tubing string in a predetermined tension between the surface injector and the subsea assist jack.

9. The method moving a coiled tubing string into and/or out of water of claim 7, further comprising using the controller to determine a continuous movement rate of the surface injector versus an interrupted rate of the subsea assist jack.

10. The method moving a coiled tubing string into and/or out of water of claim 7, further comprising remotely disengaging the subsea assist jack from gripping the coiled tubing string when a force supplied by the subsea assist jack is no longer required to move the coiled tubing string into or out of the subsea well.

* * * * *